US006468931B1

(12) United States Patent
Reeder et al.

(10) Patent No.: US 6,468,931 B1
(45) Date of Patent: Oct. 22, 2002

(54) MULTILAYER THERMALLY BONDED NONWOVEN FABRIC

(75) Inventors: James O. Reeder, Greenville; David D. Newkirk, Greer, both of SC (US)

(73) Assignee: Fiberweb North America, Inc.

( * ) Notice: Subject to any disclaimer, the term of this patent is extended or adjusted under 35 U.S.C. 154(b) by 1507 days.

(21) Appl. No.: 08/701,734

(22) Filed: Aug. 22, 1996

Related U.S. Application Data

(63) Continuation of application No. 08/400,435, filed on Feb. 28, 1995, now abandoned, which is a continuation-in-part of application No. 08/091,755, filed on Sep. 3, 1993, now abandoned.

(51) Int. Cl.[7] ..... B32B 5/26

(52) U.S. Cl. ..... 442/381; 428/198; 428/171; 428/172; 428/296; 428/286; 428/298; 428/369; 442/382; 442/389; 442/392

(58) Field of Search ..... 428/198, 171, 428/172, 296, 286, 369, 298; 442/381, 382, 389, 392

(56) References Cited

U.S. PATENT DOCUMENTS

| | | | | | |
|---|---|---|---|---|---|
| 3,870,592 | A | * | 3/1975 | Brock et al. | 161/148 |
| 3,881,490 | A | * | 5/1975 | Whitehead et al. | 128/287 |
| 4,077,410 | A | | 3/1978 | Butterworth et al. | 128/287 |
| 4,304,234 | A | | 12/1981 | Hartmann | 128/287 |
| 4,332,253 | A | | 6/1982 | Schoots | 128/287 |
| 4,436,780 | A | * | 3/1984 | Hotchkiss et al. | 428/198 |
| 4,585,449 | A | | 4/1986 | Karami | 604/378 |
| 4,761,322 | A | * | 8/1988 | Raley | 428/198 |
| 4,762,520 | A | | 8/1988 | Wallström | 604/366 |
| 4,780,352 | A | | 10/1988 | Palumbo | 428/138 |
| 4,798,603 | A | | 1/1989 | Meyer et al. | 604/378 |
| 4,854,984 | A | | 8/1989 | Ball et al. | 156/73.5 |
| 4,883,707 | A | * | 11/1989 | Newkirk | 428/219 |
| 4,892,534 | A | * | 1/1990 | Datta et al. | 604/370 |
| 4,892,535 | A | * | 1/1990 | Bjornberg et al. | 604/380 |
| 4,935,295 | A | | 6/1990 | Serafini | 428/286 |
| 5,045,387 | A | | 9/1991 | Schmalz | 428/284 |
| 5,104,728 | A | * | 4/1992 | Obermeyer et al. | 428/286 |
| 5,114,787 | A | * | 5/1992 | Chaplin et al. | 428/284 |
| 5,198,057 | A | * | 3/1993 | Newkirk et al. | 156/83 |
| 5,219,633 | A | * | 6/1993 | Sabee | 428/109 |
| 5,229,191 | A | * | 7/1993 | Austin | 428/198 |
| 5,270,107 | A | * | 12/1993 | Gessner | 428/296 |

FOREIGN PATENT DOCUMENTS

| | | |
|---|---|---|
| EP | 106604 | 4/1984 |
| EP | 586937 | 3/1994 |
| GB | 2239215 | 6/1991 |
| SE | 351527 | 2/1961 |

OTHER PUBLICATIONS

Polymers: Fibers and Textiles, a Compendium, pub. John Wiley & Sons, Inc., 1990, New York, p. 564.*

* cited by examiner

*Primary Examiner*—Terrel Morris
*Assistant Examiner*—Arti R. Singh
(74) *Attorney, Agent, or Firm*—Alston & Bird LLP

(57) ABSTRACT

A multilayer thermally bonded nonwoven fabric which is particularly useful as a liner in an absorbent product is described. The fabric includes at least two prebonded nonwoven webs having a multiplicity of intralaminar bonds bonding the fibers of the prebonded nonwoven webs together. The prebonded webs are secured together to form the fabric of the invention by a plurality of interlaminar thermal bonds formed of discrete areas of compressed and fused fibers of the prebonded webs.

19 Claims, 8 Drawing Sheets

MULTILAYER THERMALLY BONDED NONWOVEN FABRIC

This application is a Continuation of application Ser. No. 08/400,435, now abandoned filed Feb. 28, 1995, which in turn is a Continuation of Ser. No. 08/091,755, now abandoned filed Sep. 3, 1993.

FIELD OF THE INVENTION

The present invention relates to nonwoven fabrics and to processes for producing the nonwoven fabrics. More specifically, the invention relates to nonwoven fabrics suitable for use in absorbent products, such as disposable diapers, adult incontinence pads and sanitary napkins, and the like.

BACKGROUND OF THE INVENTION

Nonwoven fabrics a re desirable for use in a variety of products, including bandaging materials, garments, diapers, supportive clothing and personal hygiene products. Nonwoven fabrics that are capable of transmitting body fluids to an absorbent layer while maintaining skin dryness are particularly desirable for use as a coverstock layer in disposable personal care products.

Disposable absorbent products, such as disposable diapers, sanitary napkins, and the like, typically include a liquid impermeable outer covering, an absorbent layer, and an inner layer which contacts the skin of the wearer. To provide a comfortable yet effective product, the inner layer ideally permits liquid to flow through it rapidly into the absorbent layer ("rapid strike through") but does not permit or, at a minimum does not facilitate, re-transmission of liquid from the absorbent layer to the "wearer" side of said inner layer ("resists rewet"). Such inner layers are referred to in the art as coverstock, topsheet, or, in diaper applications, diaper liner.

In addition to liquid transport properties described above, the coverstock must have sufficient strength to allow for converting it, i.e., incorporating it into the final product, and for resistance to failure during vigorous movements by the user. On the other hand, while strength is essential, the coverstock should also present a soft comfortable feel against the user's skin. Currently these conflicting requirements, both softness coupled with strength and rapid strike-through coupled with low surface rewet, are met only imperfectly, typically with the use of coverstock stock made from thin, low basis weight (about 22 grams per square meter or about 20 grams per square yard) carded or spunbonded nonwoven fabrics.

Others have attempted to provide products having improved coverstock performance. U.S. Pat. No. 4,041,951 to Sanford discloses a topsheet containing a multiplicity of depressed areas which intimately contact the uppermost surface of a substantially planar, moisture absorbent layer, while the non-depressed areas of the topsheet contact the skin of the wearer in use. The depressed areas are formed by embossing a nonwoven web between a patterned steel roll having male projections thereon and a rubber coated roll. A pattern is formed on the nonwoven web such that the caliper or the density of the web at the depressed embossed sites is not changed from that seen in the un-embossed part of the roll.

U.S. Pat. No. 4,854,984 to Ball et. al. teaches a method for dynamically bonding a plurality of laminae together wherein the laminae are forwarded in face to face relation through a pressure-biased nip between a patterned nip and opposing nip, each independently driven to maintain a predetermined surface velocity differential between them. The differential velocity is stated to contribute to shear energy to enable dynamic, mechanically induced bonding.

Suzuki et. al. in U.S. Pat. No. 4,704,112 describe a diaper topsheet made by combining two layers of nonwoven webs at their interface by fiber fusion or by hydroentangling. At least one of the webs must be apertured.

Meyer et.al. in U.S. Pat. No. 4,798,603 teach an absorbent article, i.e., a diaper, that includes a second nonwoven layer under the topsheet and above the absorbent core composed of a material less hydrophilic than said absorbent core and having an average pore size smaller than the topsheet layer pore size. The patent states that bonds used to attach the transport layer to the rest of the diaper construction should not extend completely through the transport layer thickness.

Datta et. al. in U.S. Pat. No. 4,892,534 describe a nonwoven liner fabric particularly useful for feminine care applications that contains at least three layers of thermoplastic filaments which are laid down via spunbond methods and then bonded together.

Schmalz U.S. Pat. No. 5,045,387 is directed to a topical treatment of polyolefin containing nonwoven webs. The patent describes the use of a facing or cover sheet for sanitary products such as diapers wherein the webs are made from polypropylene and can be formed by spunbonding. The patent further states that the nonwovens can be formed of one or more bonded webs, and that the nonwoven fabric can be embossed and/or calendar printed with various designs and colors.

U.S. Pat. Nos. 4,077,410; 4,332,253 and 4,762,520, 4,883,707; 4,304,234 all disclose the use of plural layers of nonwoven fabrics as the topsheet in a sanitary product. Braun in U.S. Pat. No. 4,668,566; Raley in U.S. Pat. No. 4,761,322; and Modrak in European Patent Application 0490476-A1 teach the combination of one bonded nonwoven web with an unbonded nonwoven web. The resulting combination is bonded together so a final structure results. Meitener in U.S. Pat. No. 4,493,868 teaches methods to put multiple bond patterns on a nonwoven web.

U. S. Patent No. 3,934,588 to Mesek et al. discloses a diaper topsheet with areas of preferential flow, surrounded by borders having less transmissivity for aqueous liquids than the preferential flow areas. Mesek teaches the use of areas of reduced thickness via a lesser amount of fibers, areas of increased surfactant concentration, or areas of increased hydrophobic binder application to produce his areas of preferential flow or resistance to flow.

U.S. Pat. No. 4,863,785 to Berman et. al. teaches the combination of a meltblown fabric layer between two prebonded spunbonded nonwoven layers, all continuously bonded together, to form a composite that is highly resistant to the penetration of liquids and thus useful as a sterilization wrap for medical applications. U.S. Pat. No. 4,041,203 to Brock et al. teaches the combination of a meltblown fabric layer between two spunbonded layers, all bonded together by discrete bond regions, to form a composite that is also useful in medical applications which require a barrier layer to prevent the passage of liquid and bacteria.

SUMMARY OF THE INVENTION

The present invention provides a multilayer thermally bonded nonwoven fabric which is particularly useful as a component in an absorbent article. The nonwoven fabrics of the present invention provide improved surface visual patterns or designs. Hydrophilic nonwoven fabrics of the present invention can provide superior liquid transport properties and thus are particularly useful as the liner layer in an absorbent article. These desirable properties are achieved at reasonable cost while preserving acceptable softness and strength properties.

The nonwoven fabrics of the invention include at least two prebonded nonwoven webs. The term "prebonded" refers to the use of nonwoven webs that are each individually bonded to form coherent webs. That is, each of the prebonded webs includes a multiplicity of intralaminar bonds between fibers that bond the fibers of the prebonded nonwoven webs together. Preferably, the prebonded webs are bonded by discrete point bonds located at spaced locations throughout each of the webs.

The multilayer thermally bonded nonwoven fabric also includes a plurality of interlaminar thermal bonds which secure the prebonded webs together. To form the interlaminar thermal bonds, discrete areas of the fibers of the prebonded webs are thermally treated so that the fibers are compressed and fused together. In a preferred embodiment of the invention, the discrete areas of compressed and fused fibers form continuous line bonds, which in turn form a pattern of intersecting continuous lines. Further, using such a bond pattern, a quilted, or pillowy texture can be imparted to the surface of the fabrics of the invention.

In another embodiment of the invention, disposable absorbent articles are provided which include as a component a multilayer thermally bonded fabric according to the invention. Certain hydrophilic fabrics of the invention are particularly useful as a component, such as a liner or topsheet layer, in disposable absorbent products such as diapers and the like. In this embodiment of the invention, an absorbent body or layer is sandwiched between the fabric of the invention and an outer backsheet layer of a substantially liquid impermeable layer.

Hydrophilic nonwoven fabrics of the present invention can provide superior liquid transport properties, i.e., permit liquid to flow through the fabric rapidly while retarding re-transmission of the liquid to the surface of the fabrics. Further, the fabrics of the invention provide a soft, comfortable feel while also having good strength properties.

BRIEF DESCRIPTION OF THE DRAWINGS

In the drawings which form a portion of the original disclosure of the invention.

DETAILED DESCRIPTION OF THE INVENTION

In the following detailed description of preferred embodiments of the invention, specific terms are used in describing the invention; however these are used in a descriptive sense only and not for the purpose of limitation. It will be apparent that the invention is susceptible to numerous variations and modifications within its spirit and scope.

Figure 1:
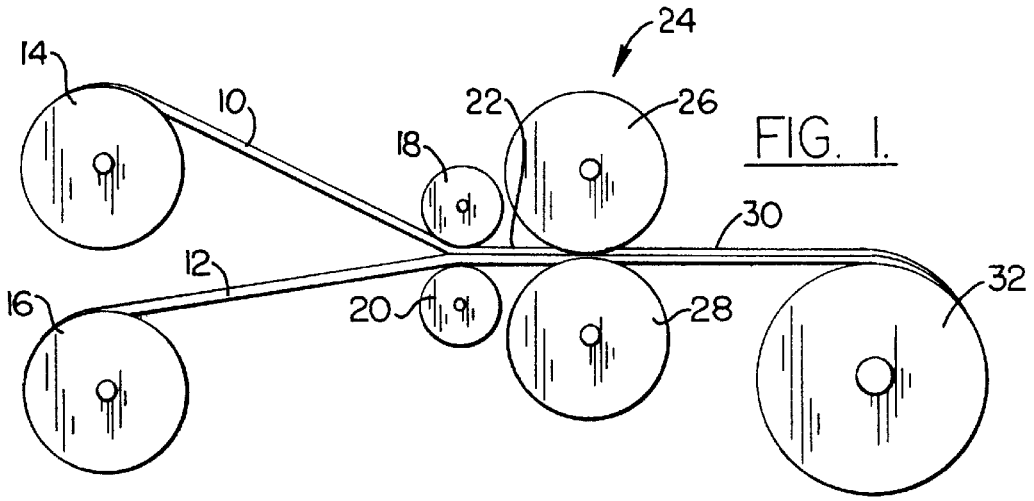
FIG. 1 is a schematic illustration of one method for producing a multilayer thermally bonded nonwoven fabric in accordance with the invention.

FIG. 1 is a schematic illustration of one method for producing a multilayer thermally bonded nonwoven fabric in accordance with the invention. First and second prebonded nonwoven webs 10, 12 are unrolled from respective supply rolls 14 and 16, and directed by suitable guide rolls, such as rolls 18, 20, into opposing, face-to-face relationship to form a two layered structure 22.

Each of the prebonded nonwoven webs 10 and 12 may be formed of substantially continuous filaments or formed of staple fibers. In one embodiment of the invention, at least two prebonded nonwoven webs formed of substantially continuous filaments are provided. In another embodiment of the invention, at least two prebonded nonwoven webs formed of staple fibers are provided. The nonwoven fabrics of the present invention may also include at least one prebonded web of continuous filaments and at least one prebonded web of staple fibers. The webs may be of similar or different fiber compositions and basis weight.

As used herein, the term "prebonded" refers to the presence of a multiplicity of intralaminar bonds between fibers in each of the individual webs. The intralaminar bonds bond the fibers of the webs together to give the webs sufficient strength and integrity to withstand handling. Preferably, the intralaminar bonds are discrete point bond sites located at spaced locations throughout the prebonded nonwoven webs. Advantageously, the bond sites have a bond area of about 5 to 30 percent of the area of the web.

Preferably the bonds are thermal bonds formed by heating the fibers so that they soften and become tacky, and fuse together contacting portions of the fibers. The thermal bonds may be formed using any of the techniques known in the art for forming discrete thermal bonds, such as calendering. Other thermal bonding techniques, such as thru-air bonding and the like, may also be used.

Each web contains thermoplastic fibers, and may also include other, non-thermoplastic fibers. Exemplary thermoplastic polymers include, but are not limited to, polyolefins such as polypropylene and polyethylene, polyesters such as poly(ethylene terephthalate), polyamides such as poly (hexamethylene adipamide) and poly(caproamide), and blends and copolymers thereof. The thermoplastic polymer is present in the fibers of the prebonded webs in an amount sufficient so that upon thermal bonding, the fibers in at least one of the webs is compressed and melt-fused with fibers of the other webs to thereby secure the webs together, as described in more detail below.

When webs 10 and/or 12 are formed of staple fibers, the webs may be formed by any of the methods known in the art for forming a nonwoven web of staple fibers, such as carding, air laying, garnetting, and similar processes known in the art. Further, when prebonded nonwoven webs 10 and/or 12 are webs of thermoplastic staple fibers, the nonwoven web may also include other staple thermoplastic and/or natural fibers, such as fibers formed from a polyolefin such as polypropylene and polyethylene, polyester, polyamides, polyacrylates, rayon, cellulose acetate and the like. Natural fibers include cotton fibers, wool fibers, wood pulp fibers and the like. Blends of such fibers can also be used.

In one embodiment of the invention, the staple fibers employed can be sheath/core or similar bicomponent fibers. Preferred bicomponent fibers include polyolefin/polyolefin sheath/core fibers such as a polyethylene/polypropylene sheath/core fibers and polyolefin/polyester sheath/core fibers, such as a polyethylene/polyethylene terephthalate sheath/core fiber.

When webs 10 and/or 12 are formed of continuous filaments, the webs may be formed by any of the methods known in the art for forming a nonwoven web of continuous filaments, such as spunbonding processes. As known to the skilled artisan, spunbonding processes generally include the following steps: (1) extruding continuous filaments; (2) quenching the filaments; (3) drawing or attenuating the filaments by a high velocity fluid; and (4) collecting the filaments on a surface to form a web. Exemplary spunbonding techniques are described in U.S. Pat. Nos. 3,338,992; 3,341,394; 3,276,944; 3,502,538; 3,502,763; 3,509,009; 3,542,615; and 3,692,618.

An exemplary list of prebonded nonwoven webs used in accordance with the present invention includes, but is not limited to, spunbond polypropylene nonwoven webs, spunbond polyethylene nonwoven webs, thru-air bonded carded webs of bicomponent fibers, thermobonded carded polypropylene fiber webs, and webs of thermobonded carded blends of polypropylene fiber and rayon fiber. Spunbond polypropylene nonwoven fabrics having a basis weight from about 5 to 30 gsm and thermobonded carded polypropylene fiber nonwoven fabrics having a basis weight from about 10 to 30 gsm are especially preferred and are available from FIBERWEB North America, Simpsonville, S.C. The preparation of thru-air bonded carded webs of bicomponent fibers is described in U.S. Pat. No. 4,883,707.

Referring back to FIG. 1, two layered structure 22 is conveyed in the longitudinal direction as indicated in FIG. 1 to a thermal treatment station 24, illustrated in FIG. 1 as heated calender rolls 26 and 28. Here the two layered structure 22 is treated to form a plurality of interlaminar thermal bonds which secure prebonded webs 10 and 12 together to form the product of the invention, fabric 30.

To form the interlaminar thermal bonds, the fibers of prebonded webs 10 and 12 are compressed and fused at discrete areas of the prebonded webs. The operating temperature of heated rolls 26 and 28 should be adjusted to a surface temperature such that the fibers of the prebonded nonwoven webs are compressed and fused together. As used herein, the term "fusing" refers to heating the fibers so that the fibers soften and become tacky, thus adhering to one another. Preferably, the fibers do not completely melt but rather soften without significant loss of individual fiber structural integrity. Bonding conditions, including temperature and pressure, vary according to the particular polymer used and are known in the art for differing polymers.

The thermally bonded nonwoven fabric 30 is then removed from the thermal treatment station 24 and wound by conventional means onto roll 32. The nonwoven fabric can be stored on roll 32 or immediately passed to end use manufacturing processes, for example, for use in bandages, diapers, disposable undergarments, personal hygiene products, and the like.

The heated calender rolls 26 and 28 in FIG. 1 may consist of a pair of pattern rolls, a pattern roll and a smooth steel roll, a pattern roll and a rubber roll or other roll combinations known in the art. The pattern of the calender rolls may be any of those known in the art, including spot bonding patterns, helical bonding patterns, line bonding patterns, and the like. The term spot bonding is used herein to be inclusive of continuous or discontinuous pattern bonding, uniform or random point bonding, or a combination thereof, all as are well known in the art.

Figure 2:
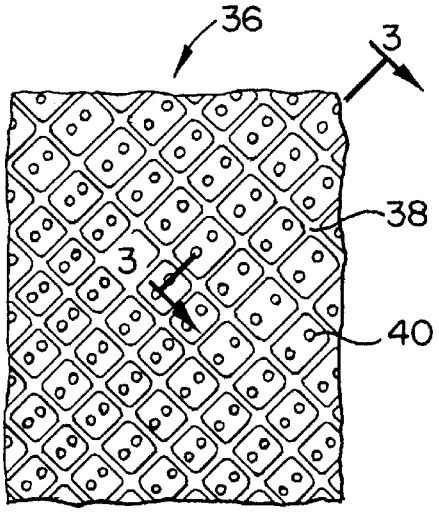
FIG. 2 is a fragmentary top plan view of a nonwoven fabric in accordance with the invention.

Referring to FIG. 2, a fragmentary top plan view of one embodiment of a bonding pattern useful for bonding the nonwoven fabrics of the present invention is illustrated. Specifically, FIG. 2 illustrates a nonwoven fabric 36 thermally bonded via interlaminar continuous line bonds, designated generally at 38. In FIG. 2, the continuous line bonds comprise lines of discrete areas of compressed and fused fibers of the prebonded webs, as described above, and form a pattern of intersecting lines. That is, intersecting bond lines are arranged so that a repeating "diamond" pattern is formed. By proper choice of the embossing pattern, a wide variety of visual patterns can be produced. In addition, FIG. 2 illustrates intralaminar discrete point bond sites, designated generally at 40, in the prebonded webs as described above.

Figure 6A:
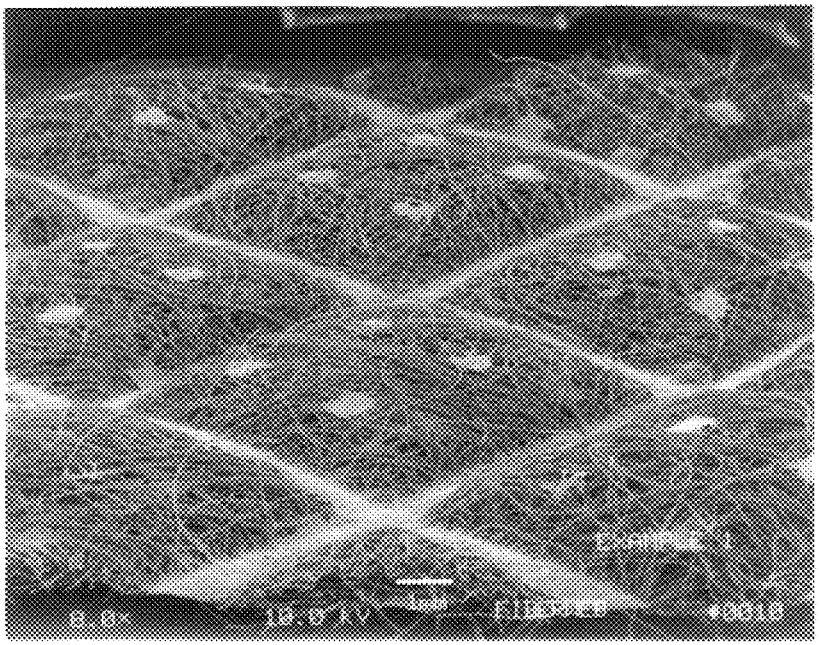
FIGS. 6A and 6B are photomicrographs taken at 8× and 12.5× magnification, respectively, at an angle of the nonwoven fabric of FIGS. 5A and 5B.
Figure 6B:
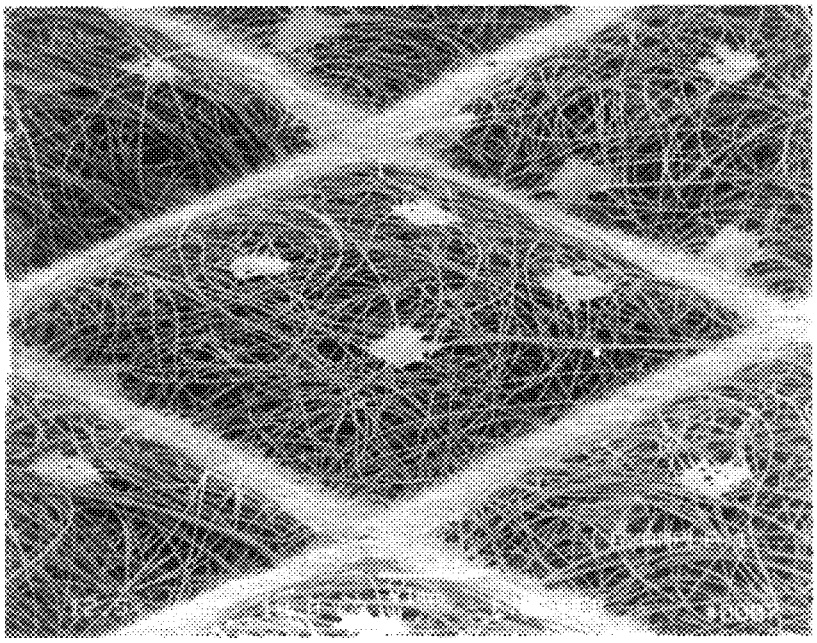

The diamond pattern of FIG. 2 illustrates another feature of the nonwoven fabrics of the invention. FIG. 2 illustrates a distinct pattern of "pillows" or portions of the surfaces of the individual prebonded webs raised between the intersecting bond lines. This gives a quilt-like appearance to the surface, or topography, of the fabric. This surface feature of the fabrics of the present invention is best illustrated in FIGS. 6A and 6B, described below.

Figure 3:
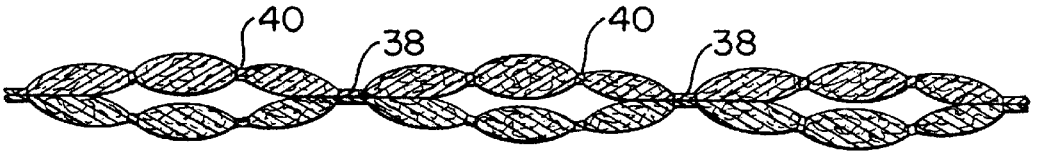
FIG. 3 is a cross sectional view of the nonwoven fabric of FIG. 2 taken along line 3—3.

FIG. 3 is a cross-section view of the fabric illustrated in FIG. 2 taken along line 3—3. FIG. 3 illustrates a two layer structure, the intralaminar bonds 40 bonding the fibers of each of the webs together to form coherent webs, and interlaminar bonds 38 bonding the webs together to form a unitary structure.

Although a preferred method of bonding has been illustrated in FIG. 1, the heated calender rolls 26 and 28 can, in other embodiments of the invention, be replaced by other thermal activation zones which compress and fuse the fibers of the prebonded webs. For example, the thermal treatment station may be in the form of a through-air bonding oven or in the form of a microwave or other RF treatment zones, so long as thermal bonds are formed by compressing and fusing the fibers of the prebonded nonwoven webs. Other heating stations such as ultrasonic welding stations can also be advantageously used in the invention. Such conventional heating stations are known to those skilled in the art and are capable of effecting substantial thermal fusion of the nonwoven webs via thermal bonds.

For example, a process similar to the Pinsonic process taught in U.S. Pat. No. 3,733,238, the entirety of which is hereby incorporated by reference, can be used. In this embodiment of the process, a horn could supply sonic energy to two or more prebonded nonwoven webs held against a rotary pattered Anvil roll. By choice of the pattern on the rotary Anvil roll a wide variety of visual patterns or designs can be achieved on the fabric.

In a preferred embodiment, the resultant multilayer thermally bonded fabric has hydrophilic properties. When the prebonded webs are formed of a hydrophobic material, such as polypropylene, hydrophilic properties are imparted using any of the techniques known in the art. For example, an additive may be added to the polymer which upon extrusion or upon post formation treatment migrates to the surface of the fibers to impart hydrophilic properties to the surface of the fibers. Alternatively, either of the prebonded webs or the resultant fabric can be treated with any of the surfactants known in the art to thereby impart hydrophilic properties to the fabric. U.S. Pat. No. 5,104,728 to Obermeyer and Cashin, the entire disclosure of which is hereby incorporated by reference, describes one such surfactant treatment.

The multilayer thermally bonded nonwoven fabrics of the present invention provide several desirable and yet apparently opposing properties in one fabric. Superior liquid transport properties are exhibited by the hydrophilic fabrics of the invention. As noted in results for the samples described in the following examples, very rapid strike-through, nearly 0.5 second faster than current commercially available topsheet, is often seen. Further, surface rewet values are similar to that seen with current commercially available topsheet. This combination of contradictory properties of rapid strike-through yet low surface wetness is highly desirable for liner applications in absorbent articles, such as diaper topsheets.

While not limited to a particular theory of the invention, it is believed that the unique improvement in liquid transport seen in the hydrophilic multilayer nonwoven fabrics of the invention may be due to the interlaminar thermal bonds formed by compressing and melt-fusing fibers of the prebonded nonwoven webs. Modification of the capillary nature of the webs in these bonding regions may promote very rapid liquid transport through the nonwoven fabrics. The balance of the surface of the nonwoven fabrics, comprising multiple layers of initially bonded nonwoven webs, then provides a barrier to rewet back from the diaper core.

The method illustrated in FIG. 1 is susceptible to numerous preferred variations. For example, although the schematic illustration of FIG. 1 shows nonwoven webs supplied as rolls of preformed webs, it will be apparent that the webs can be formed directly during the in-line process. The multilayer fabric 30 of FIG. 1 comprises a two layer structure, but there may be two or more similar or dissimilar webs depending upon the particular properties sought for the fabric.

The hydrophilic nonwoven fabrics of the present invention may be used as a nonwoven component in a disposable absorbent personal care product, such as a liner or "topsheet" layer in a diaper, an incontinence pad, a sanitary napkin, and the like; as a wipe; and the like.

Figure 4:
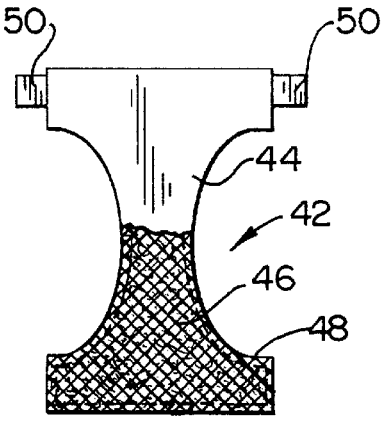
FIG. 4 is a fragmentary top plan view of one embodiment of an absorbent article incorporating a nonwoven fabric in accordance with the invention.

FIG. 4 illustrates a fragmentary top plan view of one aspect of this embodiment of the invention. In FIG. 4, the hydrophilic nonwoven fabric of the invention is used as a topsheet layer in a disposable diaper, designated generally at 42. Disposable diaper 42 includes a substantially liquid impermeable backsheet layer 44, an absorbent layer 46 positioned on backsheet layer 44, and a topsheet layer 48 positioned on absorbent layer 46, formed of a nonwoven fabric in accordance with the present invention.

As illustrated, topsheet layer 48 and backsheet layer 44 are essentially coextensive and extend out past the edges of absorbent layer 46 to form marginal edges about the periphery of diaper 42. Further, diaper 42 is illustrated as having a general hourglass or I-shape, but as will be appreciated by the skilled artisan, other product shapes may be used, depending upon the desired properties and end use of the product. Diaper 42 can also include means 50 for fastening the diaper on the wearer. As illustrated, fastening means 50 are adhesive tape tabs; however, any of the fastening means known in the art, such as hooks, clips, snaps, and the like, may be used.

Backsheet layer 44 may be any of the types of substantially liquid impermeable layers known in the art for use with disposable absorbent products. For example, backsheet layer 44 may be a polymer film, such as a polyolefin film, such as polypropylene or polyethylene. Backsheet layer 44 can also include a nonwoven material, such as a spunbonded nonwoven web, which has been suitably treated to impart a desired degree of liquid impermeability thereto, for example, by combining the nonwoven material with a polymer film.

Absorbent layer 46 can be any of the absorbent layers known in the art for use in an absorbent disposable product. For example, absorbent layer 46 can be a preformed web substantially made of cotton-like woody pulp. Wood pulp may be included in the absorbent layer, preferably by incorporating the wood fiber from a hammer milled water laid web or from an air laid web which may contain staple textile fibers, such as cotton, reconstituted cellulose fibers, e.g., rayon and cellulose acetate, polyolefins, polyamides, polyesters, and acrylics. The absorbent layer may also include an effective amount of an inorganic or organic high-absorbency (e.g., superabsorbency) material as known in the art to enhance the absorptive capability of the absorbent layer.

The nonwoven fabric may be combined with absorbent layer 46 and substantially liquid impermeable backsheet layer 44 in any of the ways known in the art, such as gluing with lines of hot-melt adhesive, seaming with ultrasonic welding, thermal bonding, high pressure bonding and the like.

By using a topsheet layer comprising the hydrophilic multilayer nonwoven fabric of the present invention, the topsheet layer advantageously permits liquid to rapidly flow through it into the absorbent layer but does not facilitate re-transmission of liquid back from the absorbent layer to the body side of the topsheet.

The following examples serve to illustrate the invention but are not intended to be limitations thereon.

ILLUSTRATIVE EXAMPLES

Example 1

Three hydrophilic spunbonded webs, each having a basis weight of approximately 10 gsm (8.5 g/yd$^2$) and consisting of 100 percent polypropylene filaments prebonded using a total bonded area of approximately 6 to 10 percent, were secured together via calendering between a smooth surfaced steel roll maintained at about 137° C. (278° F.) and a steel roll having an inverse diamond pattern on its surface and maintained at about 133° C. (272° F.). The inverse diamond pattern consists of two sets of raised parallel lands approximately 1 mm in height and 1 mm in width and spaced approximately between 4.85 and 4.90 mm from each other. The intersection of the two sets of parallel lands at 4.85 to 4.90 mm intervals results in a configuration of squares with the diagonals of the squares aligned in the machine and cross-machine directions, giving the perception of a diamond pattern when viewed in the machine direction. The rolls were compressed together under a pressure of about 890 kg/m (50 pounds per linear inch (pli)) and the webs were passed between the rolls at a speed of about 4 meters/minute (12 feet per minute (fpm)).

We observed a good visible diamond pattern that imparted a quilted or "pillowy" texture to the fabric.

Figure 5A:
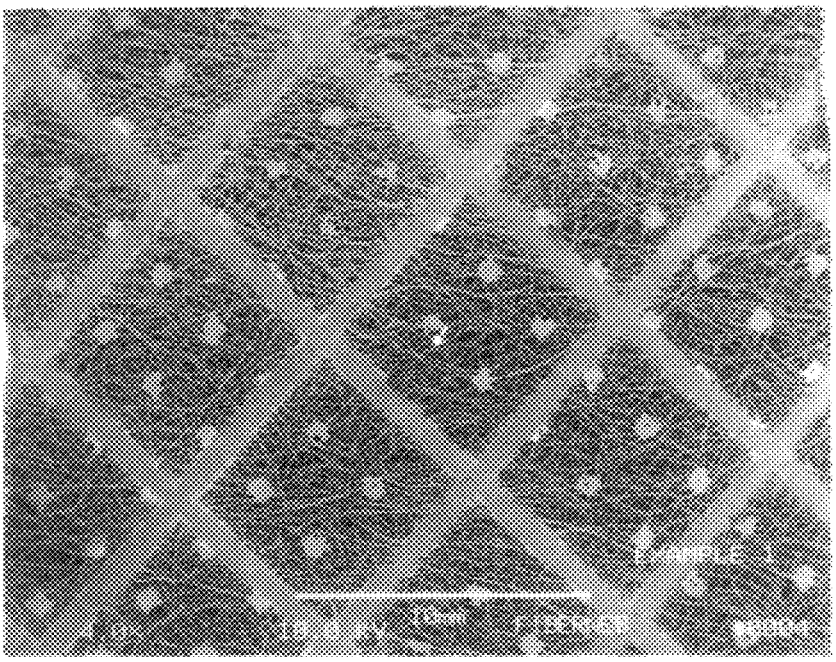
FIGS. 5A and 5B are photomicrographs taken at 4× and 8.5× magnification, respectively, of one side of a nonwoven fabric in accordance with the invention.
Figure 5B:
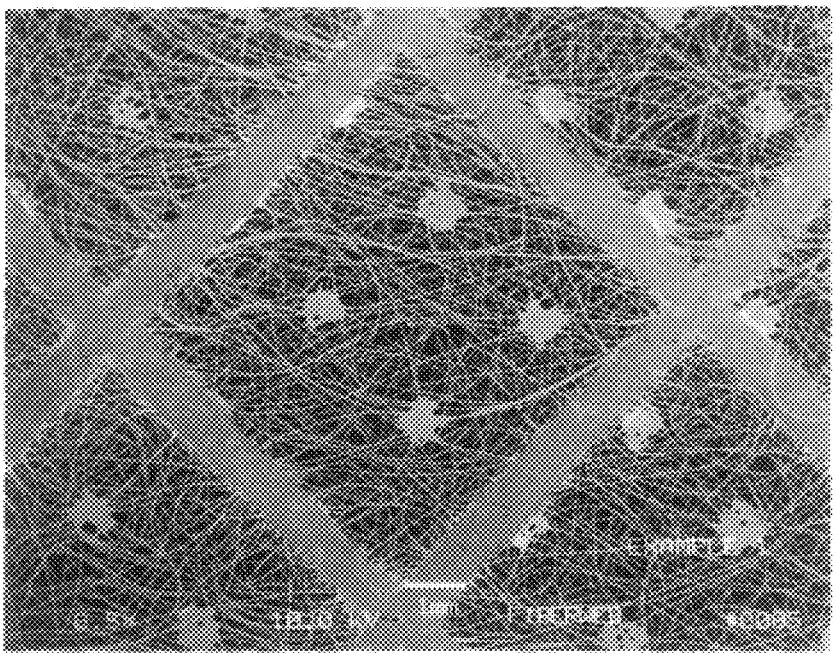

FIGS. 5A and 5B are Scanning Electron Microscope (SEM) photomicrographs of the nonwoven fabric of Example 1, taken perpendicular to the plane of the fabric at 4× and 8.5× magnifications, respectively. FIGS. 5A and 5B illustrate interlaminar continuous calender bonds of the fabric of the invention as well as intralaminar point bond sites of the prebonded nonwoven webs used to construct the fabric.

FIGS. 6A and 6B are photomicrographs taken at an angle to the plane of the fabric of Example 1 at 8× and 12.5× magnifications, respectively. FIGS. 6A and 6B illustrate the quilted-like topography of the fabric. These photographs again show the ipterlaminar continuous bonds of the fabric as well as the intralaminar point bond sites of the prebonded spunbonded nonwoven webs used to construct the fabric.

Figure 7A:
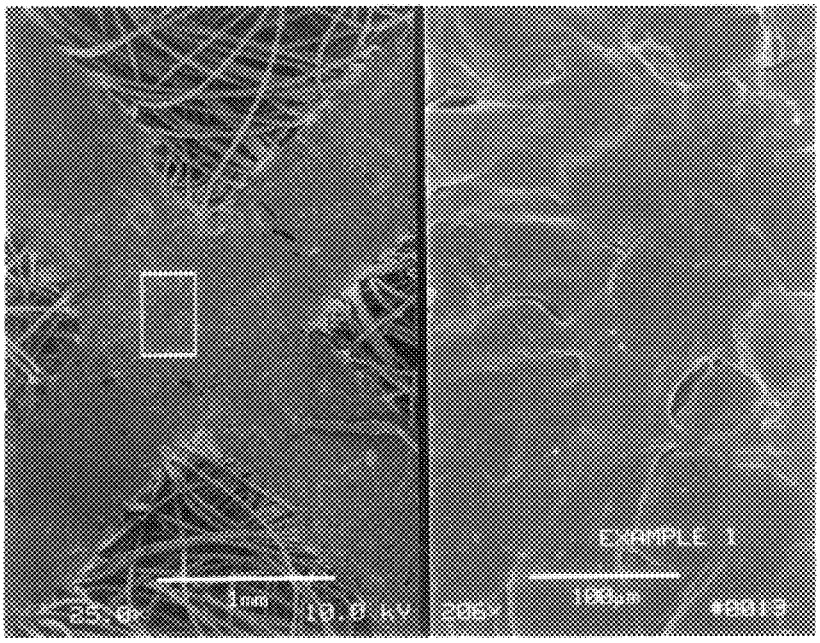
FIGS. 7A and 7B are photomicrographs taken at 25× and 206× magnification, respectively, of the nonwoven fabric of FIGS. 5A and 5B.
Figure 7B:
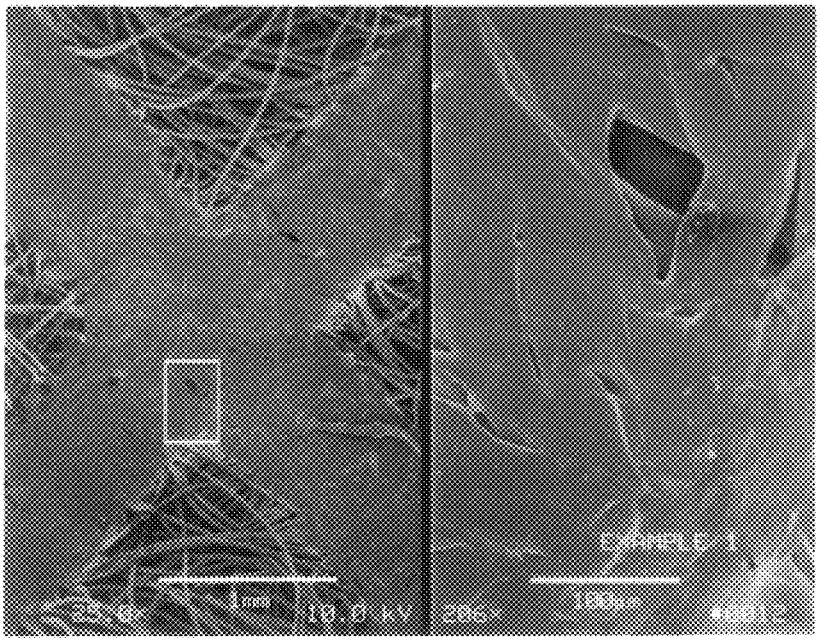

FIGS. 7A and 7B are photomicrographs taken of the product of Example 1 taken at magnifications of 25× and 206×, respectively. FIGS. 7A and 7B illustrate the interlaminar continuous calender bonds used to secure together the fabric of Example 1, and also illustrate bond formation by compression and melt-fusion or partial melt-fusion of fibers from the prebonded webs used to construct this product of the invention.

Figure 8:
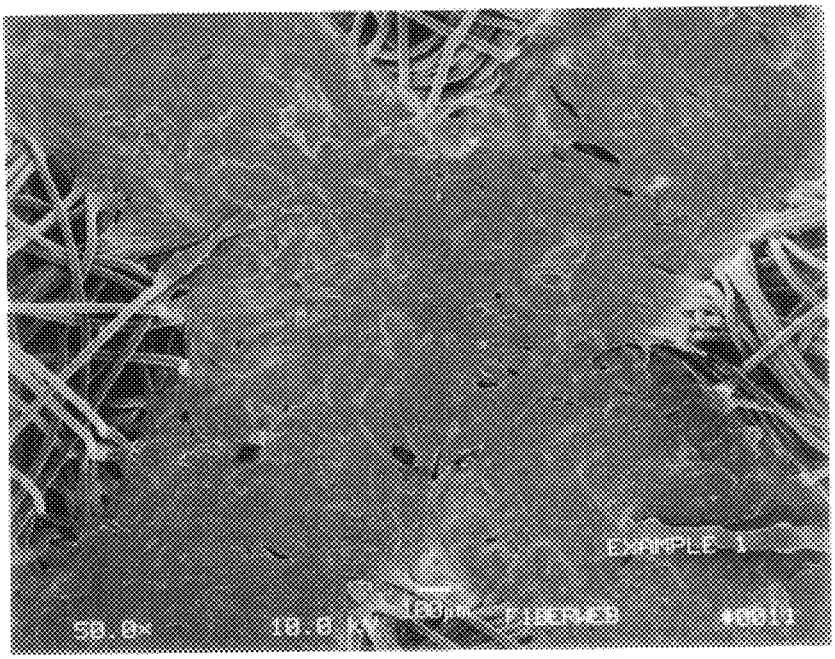
FIG. 8 is a photomicrograph taken at 50× magnification of the photomicrograph of FIGS. 7A and 7B.

FIG. 8 is a photomicrograph taken at 50× magnification of the interlaminar continuous calender bond featured in photographs 7A and 7B used to secure together the webs of the fabric of Example 1. FIG. 8 illustrates, to a greater degree, the level of melt-fusion or partial melt-fusion of fibers from prebonded webs used to construct this product of the invention.

A hand-made diaper was produced using material from Example 1 as the topsheet. A generic diaper having elastic leg bands was anchored to a stationary stand using clamps and stretched to overcome the effect of the elasticity of the leg bands so that the surface of the diaper was flat with no existing wrinkles. The existing nonwoven topsheet was detached from the diaper body by carefully cutting the topsheet alongside the inside of the existing elastic leg bands and waist shield, leaving both the leg bands and waist shield intact as part of the diaper construction. The nonwoven topsheet and underlying tissue layer was carefully removed from the diaper body without destroying the diaper core. The tissue layer was replaced with a commercially available tissue product. The nonwoven topsheet was replaced with Example 1 material and secured with hot melt glue using a commercially available hot-glue gun applicator. The pattern was clearly visible on the diaper, and the diaper had an attractive hand feel.

Example 2

Two hydrophilic spunbonded webs, each having a basis weight of approximately 15 gsm (12.5 g/yd$^2$) and consisting of 100 percent polypropylene filaments prebonded using a total bonded area of approximately 6 to 10 percent, were secured together via calendering between a smooth surfaced steel roll maintained at about 138° C. (280° F.) and a steel roll having an inverse diamond pattern on its surface as described in Example 1 and maintained at about 136° C. (276° F.). The rolls were compressed together under a pressure of about 1785 kg/m (100 pli) and the webs were passed between the rolls at a speed of about 4 mpm (12 fpm).

Example 3

Two hydrophilic spunbonded webs, each having a basis weight of approximately 15 gsm (12.5 g/yd$^2$) and consisting of 100 percent polypropylene filaments prebonded using a total bonded area of approximately 6 to 10 percent, were secured together via calendering between a smooth surfaced steel roll maintained at about 137° C. (278° F.) and a steel roll having an inverse diamond pattern on its surface as described in Example 1 and maintained at about 138° C. (280° F.). The rolls were compressed together under a pressure of about 1785 kg/m (100 pli) and the webs were passed between the rolls at a speed of about 4 mpm (12 fpm).

Example 4

Two hydrophilic carded webs, each having a basis weight of approximately 21 gsm (17.7 g/yd$^2$) and consisting of 100 percent 1.8 denier per filament (dpf) polypropylene staple fiber (commercially available from Amoco Fabrics and Fibers Company under the trade name of Amoco Type 030) and prebonded having a total bonded area of approximately 25 percent, were secured together via calendering between a smooth surfaced steel roll maintained at about 134° C. (274° F.) and a steel roll having a inverted diamond pattern on its surface as described in Example 1 and maintained at about 136° C. (273° F.). The rolls were compressed together under a pressure of about 893 kg/m (50 pli) and the webs were passed between the rolls at a speed of about 4 mpm (12 fpm).

Example 5

Two hydrophilic carded webs, each having a basis weight of approximately 14 gsm (12.0 g/yd$^2$) and consisting of 100 percent 1.5 dpf polypropylene staple fiber and prebonded having a total bonded area of approximately 25 percent, were secured together via calendering between a smooth surfaced steel roll maintained at about 134° C. (274° F.) and a steel roll having an inverse diamond pattern on its surface as described in Example 1 and maintained at about 136° C. (276° F.). The rolls were compressed together under a pressure of about 893 kg/m (50 pli) and the webs were passed between the rolls at a speed of about 6 mpm (20 fpm).

Example 6

A hydrophilic spunbonded web having a basis weight-of approximately 15 gsm (12.5 g/yd$^2$) and composed of 100 percent polypropylene filaments prebonded using a total bonded area of approximately 6 to 10 percent was overlaid with a hydrophilic carded web having a basis weight of approximately about 16 gsm (13.5 g/yd$^2$) and consisting of 100 percent of the same 1.8 dpf polypropylene staple fiber used in Example 4 and prebonded having a total bonded area of approximately 17 percent. The two-layered assembly was then secured together via calendering between a smooth surfaced steel roll maintained at about 136° C. (276° F.) and a steel roll having an inverse diamond pattern on its surface as described in Example 1 and maintained at about 135° C. (275° F.). The rolls were compressed together under a pressure of about 839 kg/m (50 pli) and the webs were passed between the rolls at a speed of about 6 mpm (20 fpm).

Example 7

Two hydrophilic spunbonded webs, each having a basis weight of approximately 15 gsm (12.5 g/yd$^2$) and consisting of 100 percent polypropylene filaments prebonded using a total bonded area of approximately 6 to 10 percent, were secured together via calendering between a smooth surfaced steel roll maintained at about 135° C. (275° F.) and a steel roll having an inverse diamond pattern on its surface as described in Example 1 and maintained at about 136° C. (276° F.). The rolls were compressed together under a pressure of about 1785 kg/m (100 pli) and the webs were passed between the rolls at a speed of about 4 mpm (12 fpm).

Example 8

Two hydrophilic carded webs, each having a basis weight of 16 gsm (13.5 g/yd$^2$) and consisting of 100 percent of the same 1.8 dpf polypropylene staple fiber used in Example 4 and prebonded having a total bonded area of approximately 17 percent, were secured together via calendering between a smooth surfaced steel roll maintained at about 135° C. (275° F.) and a steel roll having an inverse diamond pattern on its surface as described in Example 1 and maintained at about 135° C. (275° F.). The rolls were compressed together under a pressure of about 1785 kg/m (100 pli) and the webs were passed between the rolls at a speed of about 4 mpm (12 fpm).

Example 9

One hydrophilic carded web, not a product of the invention, having a basis weight of 32 gsm (27.0 g/yd2) and consisting of 100 percent of the same 1.8 dpf polypropylene staple fiber used in Example 4 and prebonded having a total bonded area of approximately 17 percent was calendering between a smooth surfaced steel roll maintained at about 136° C. (276° F.) and a steel roll having an inverse diamond pattern on its surface as described in Example 1 and maintained at about 136° C. (276° F.). The sample was compressed under a pressure of about 1785 kg/m (100 pli) and was passed between the rolls at a speed of about 4 mpm (12 fpm).

Example 10

Two hydrophilic carded webs, each having a basis weight of 16 gsm (13.5 g/yd$^2$) and consisting of 100 percent of the same 1.8 dpf polypropylene staple fiber used in Example 4 and prebonded having a total bonded area of approximately 17 percent, were secured together via calendering between a smooth surfaced steel roll maintained at about 137° C. (279° F.) and a steel roll having a wavy line pattern on its surface and maintained at about 136° C. (277° F.). The wavy line pattern consisted of multiple lines approximately 1 mm in width with a 5 mm spacing between lines, having a wavelength of approximately 40 mm with an approximately 7 mm modulation on each side of the axis running parallel with and intersecting the wavelength. The rolls were compressed together under a pressure of about 1785 kg/m (100 phi) and the webs were passed between the rolls at a speed of about 4 mpm (12 fpm).

Example 11

One hydrophilic carded web, product not part of the invention, having a basis weight of about 32 gsm (27.0 g/yd$^2$) and consisting of 100 percent of the same 1.8 dpf polypropylene staple fiber used in Example 4 and prebonded having a total bonded area of approximately 17 percent was calendering between a smooth surfaced steel roll maintained at about 135° C. (275° F.) and a steel roll having a wavy line pattern on its surface and maintained at about 136° C. (276° F.). The wavy line pattern consisted of multiple lines approximately 1 mm in width with a 5 mm spacing between lines, having a wavelength of approximately 40 mm with an approximately 7 mm modulation on each side of the axis running parallel with and intersecting the wavelength. The rolls were compressed together under a pressure of about 1785 kg/m (100 pli) and the webs were passed between the rolls at a speed of about 4 mpm (12 fpm).

Example 12

Two hydrophilic spunbonded webs, each having a basis weight of approximately 15 gsm (12.5 g/yd$^2$) and consisting of 100 percent polypropylene filaments prebonded using a total bonded area of approximately 6 to 10 percent, were secured together via calendering between two rolls, each having raised continuous helical lands as described in U.S. Pat. No. 4,863,785 to Berman et al. The bottom of the two rolls was maintained at about 137° C. (278° F.) and the top of the two rolls maintained at about 136° C. (276° F.). The rolls were compressed together under a pressure of 1785 kg/m (100 pli) and the webs were passed between the rolls at a speed of about 4 mpm (12 fpm).

Figure 9:
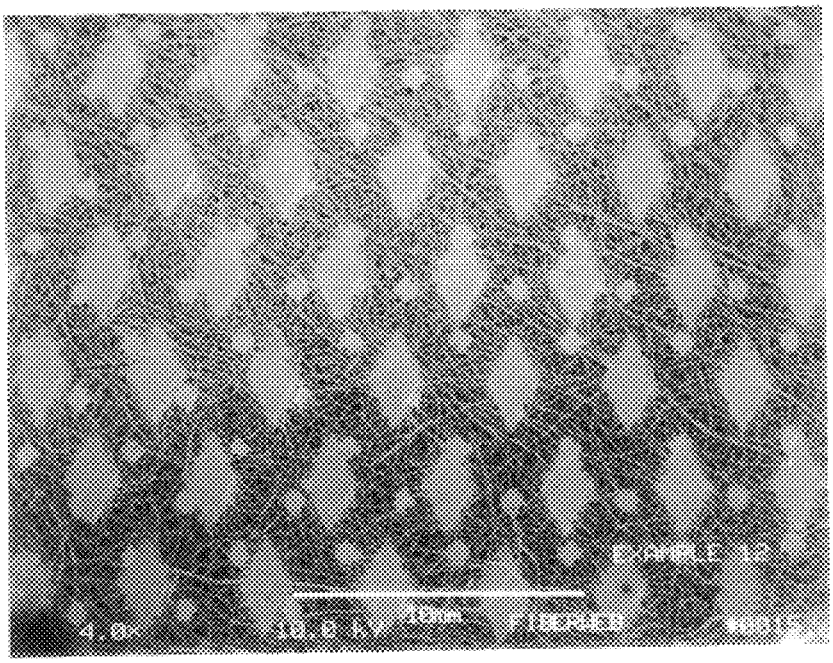
FIG. 9 is a photomicrograph taken at 4× magnification of one side of another nonwoven fabric in accordance with the invention.

FIG. 9 is a photomicrograph of the fabric of Example 12 taken perpendicular to the plane of the fabric-at 4× magnification. FIG. 9 illustrates interlaminar discontinuous calender bonds of the invention created by calendering the prebonded webs between two rolls, each having raised continuous helical lands as described in U.S. Pat. No. 4,863,785 above, as well as intralaminar discontinuous discrete point bonds of the prebonded spunbonded nonwoven webs used to construct the fabric of the invention.

Figure 10A:
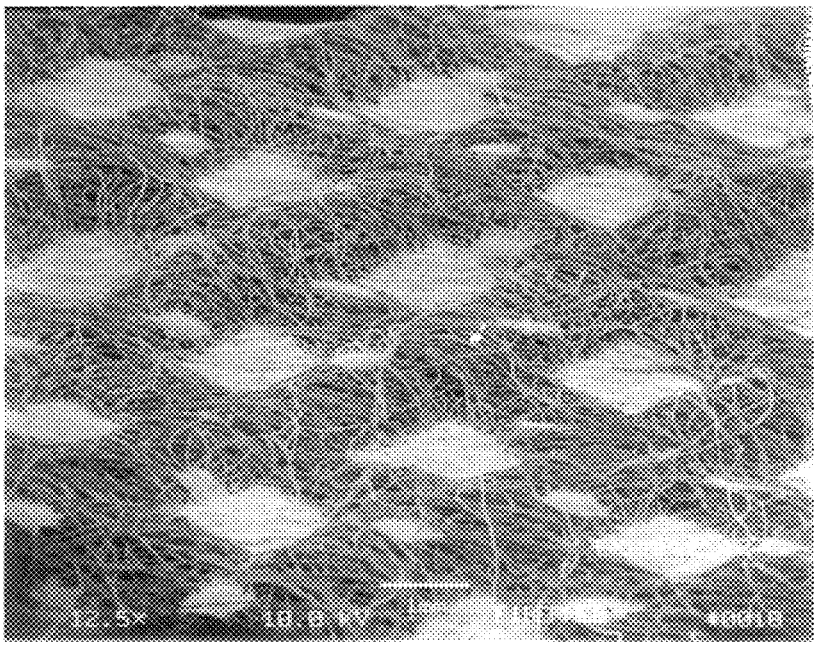
FIGS. 10A and 10B are photomicrographs taken at 12.5× and 50× magnification, respectively, at an angle of the nonwoven fabric of FIG. 9.
Figure 10B:
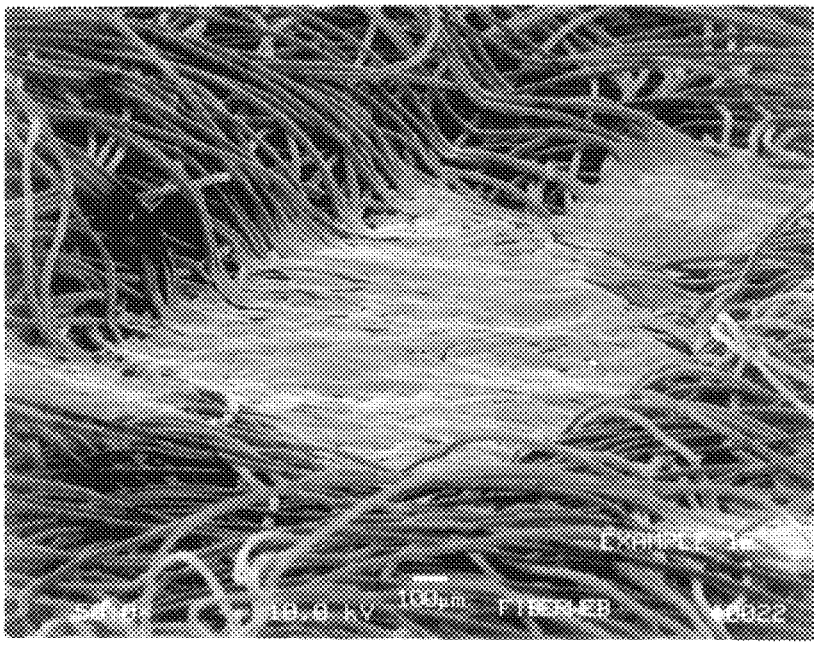

FIGS. 10A and 10B are photomicrographs taken at an angle to the plane of the fabric of Example 12 at 12.5× and 50× magnifications, respectively. FIGS. 10A and 10B illustrate the textured-like topography of the fabric of Example 12. These photographs again show interlaminar discontinuous calender bonds of the invention created by calendering the prebonded webs between two rolls, each having raised continuous helical lands as described in U.S. Pat. No. 4,863,785 above, as well as intralaminar discontinuous bonds of the prebonded spunbonded nonwoven webs used to construct the fabric of the invention.

Figure 11A:
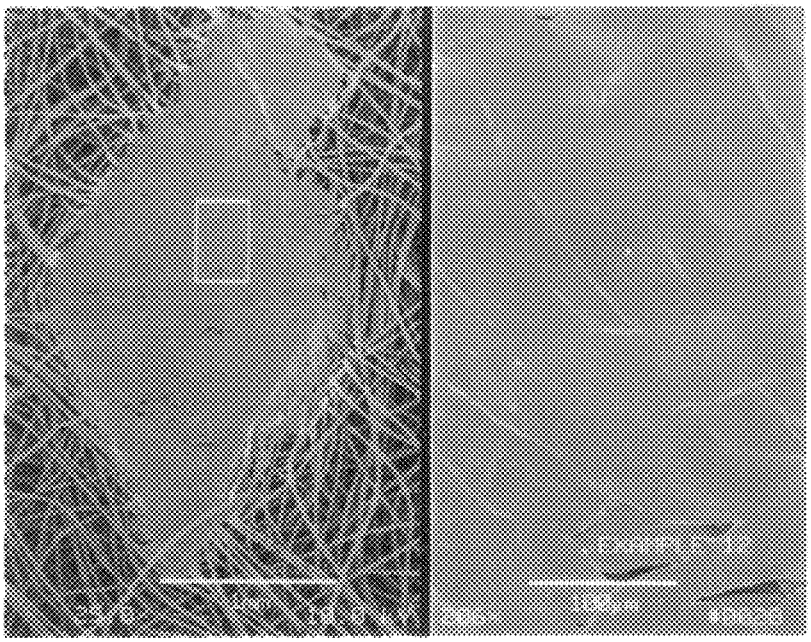
FIGS. 11A and 11B are photomicrographs taken at 25× and 206× magnification, respectively, of the nonwoven fabric of FIG. 9.
Figure 11B:
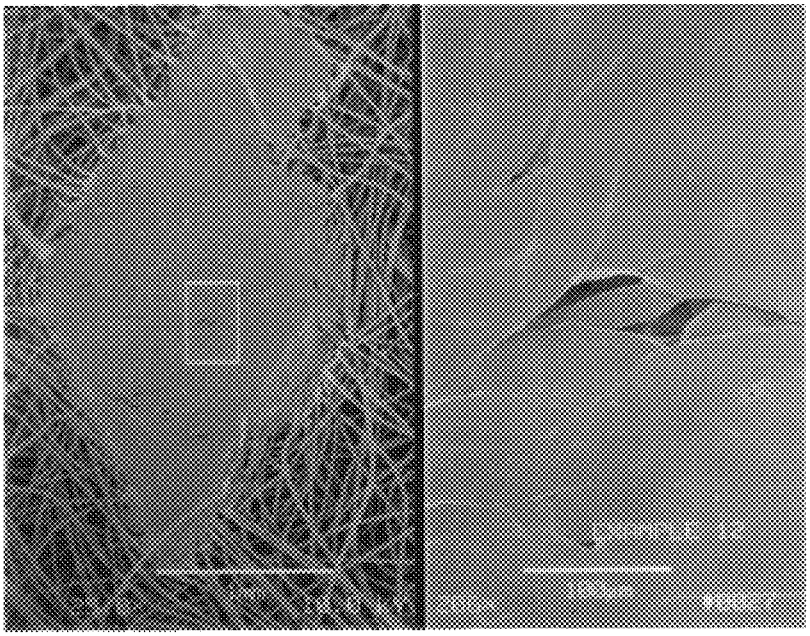

FIGS. 11A and 11B are photomicrographs taken at 25× and 206× magnifications, respectively, of the fabric of Example 12. FIGS. 11A and 11B illustrate the interlaminar discontinuous calender bonds used to secure together the fabric of Example 12. FIGS. 11A and 11B also illustrate bond formation by compression and melt-fusion or partial melt-fusion of fibers from prebonded webs used to construct this product.

Figure 12:
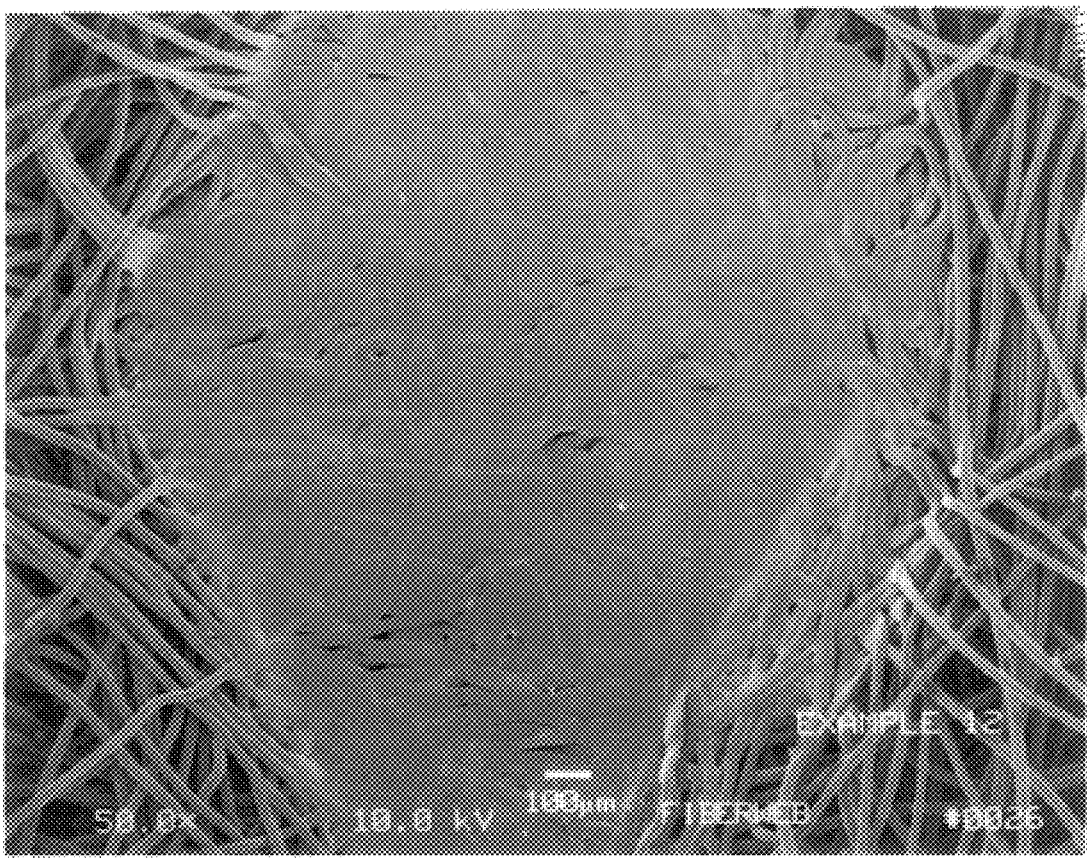
FIG. 12 is a photomicrograph taken at 50× magnification of the photomicrograph of FIGS. 11A and 11B.

FIG. 12 is a photomicrograph taken at 50× magnification of the interlaminar discontinuous calender bond featured in FIGS. 11A and 11B that was used to secure together Example 12. FIG. 12 illustrates, to a greater degree, the level of melt-fusion or partial melt-fusion of fibers from prebonded webs used to construct this product.

A hand-made diaper was produced using material from Example 12 as the topsheet. A generic diaper having elastic leg bands was anchored to a stationary stand using clamps and stretched to overcome the effect of the elasticity of the leg bands so that the surface of the diaper was flat with no existing wrinkles. The existing nonwoven topsheet was detached from the diaper body by carefully cutting the topsheet alongside the inside of the existing elastic leg bands and waist shield, leaving both the leg bands and waist shield intact as part of the diaper construction. The nonwoven topsheet and underlying tissue layer was carefully removed from the diaper body without destroying the diaper core. The tissue layer was replaced with a commercially available tissue product. The nonwoven topsheet was replaced with Example 12 material and secured with hot melt glue using a commercially available hot-glue gun applicator. The pattern was visible on the diaper, and the diaper had an attractive handfeel.

Controls for Illustrative Examples

Control Example 1A

One hydrophilic spunbonded web similar to commercially available products of FIBERWEB North America having a basis weight of approximately 10 gsm (8.5 g/yd$^2$) and consisting of 100 percent polypropylene filaments prebonded using a total bonded area of approximately 6 and 10 percent but not post-processed via calendering was evaluated as characterized in Table I-A as a control against Illustrative Example 1.

Control Example 1B

Three hydrophilic spunbonded webs, each having a basis weight of approximately 10 gsm (8.5 g/yd$^2$) and consisting of 100 percent polypropylene filaments prebonded using a total bonded area of approximately 6 and 10 percent, were overlaid in a three-layered assembly without being secured together via calendering and then evaluated as characterized in Table I-A as a control against Illustrative Example 1. The basis weight and caliper were evaluated on the one-layer uncalendered control samples and tripled for the uncalendered multi-layered control examples.

Control Example 1C

One hydrophobic spunbonded web similar to commercially available products of FIBERWEB North America, a product not part of the invention, having a basis weight of approximately 34 gsm (28.4 g/yd$^2$) and consisting of 100 percent polypropylene filaments prebonded using a total bonded area of approximately 6 and 10 percent was post-processed via calendering between a smooth surfaced steel roll maintained at about 138° C. (281° F.) and a steel roll having an inverse diamond pattern on its surface and maintained at about 137° C. (278° F.) for evaluation of visible pattern against Illustrative Example 1.

This sample had a visible diamond pattern but did not have the quilted or "pillowy" hand-feel as seen with Illustrative Example 1.

Control Example 2A

One hydrophilic spunbonded web similar to commercially available products of FIBERWEB North America having a basis weight of approximately 15 gsm (12.5 g/yd$^2$) and consisting of 100 percent polypropylene filaments prebonded using a total bonded area of approximately 6 and 10 percent but not post-processed via calendering was evaluated as characterized in Table I-A as a control against Illustrative Example 2.

Control Example 2B

Two hydrophilic spunbonded webs, each having a basis weight of approximately 15 gsm (12.5 g/yd$^2$) and consisting of 100 percent polypropylene filaments prebonded using a total bonded area of approximately 6 and 10 percent, were overlaid in a two-layered assembly without being secured together via calendering and then evaluated as characterized in Table I-A as a control against Illustrative Example 2.

Control Example 3A

One hydrophilic spunbonded web similar to commercially available products of FIBERWEB North America having a basis weight of approximately 18 gsm (15.0 g/yd$^2$) and consisting of 100 percent polypropylene filaments prebonded using a total bonded area of approximately 6 and 10 percent but not post-processed via calendering was evaluated as characterized in Table I-A as a control against Illustrative Example 3.

Control Example 3B

Two hydrophilic spunbonded webs, each having a basis weight of approximately 18 gsm (15.0 g/yd$^2$) and consisting of 100 percent polypropylene filaments prebonded using a total bonded area of approximately 6 and 10 percent, were overlaid in a two-layered assembly without being secured together via calendering and then evaluated as characterized in Table I-A as a control against Illustrative Example 3.

Control Example 4A

One hydrophilic carded web having a basis weight of approximately 21 gsm (17.7 g/yd$^2$) and consisting of 100 percent 1.8 denier per filament (dpf) polypropylene staple fiber (commercially available from Amoco Fabrics and Fibers Company under the trade name of Amoco Type 030) and prebonded having a total bonded area of approximately 25 percent but not post-processed via calendering was evaluated as characterized in Table I-A as a control against Illustrative Example 4.

Control Example 4B

Two hydrophilic carded webs, each having a basis weight of approximately 21 gsm (17.7 g/yd$^2$) and consisting of 100 percent of the same 1.8 dpf polypropylene staple fiber used in Control Example 4A above and prebonded having a total bonded area of approximately 25 percent, were overlaid in a two-layered assembly without being secured together via calendering and then evaluated as characterized in Table I-A as a control against Illustrative Example 4.

Control Example 12A

One hydrophilic spunbonded web having a basis weight of approximately 15 gsm (12.5 g/yd$^2$) and consisting of 100 percent polypropylene filaments prebonded using a total bonded area of approximately 6 to 10 percent but not post-processed via calendering was evaluated as characterized in Table I-B as a control against Illustrative Example 12.

Control Example 12B

Two hydrophilic spunbonded webs, each having a basis weight of approximately 15 gsm (12.5 g/yd$^2$) and consisting of 100 percent polypropylene filaments prebonded using a total bonded area of approximately 6 and 10 percent, were overlaid in a two-layered assembly without being secured together via calendering and then evaluated as characterized in Table I-B as a control against Illustrative Example 12.

Control Example 13

Typical physical and moisture transport properties as measured from commercially available spunbond polypropylene diaper topsheet material available from Fiberweb North America, Inc. are characterized in Table I-B.

Control Example 14

Typical physical and moisture transport properties as measured from commercially available reduced basis weight spunbond polypropylene diaper topsheet available from Fiberweb, North America, Inc. are characterized in Table I-B.

Control Example 15

Typical physical and moisture transport properties as measured from commercially available carded polypropylene diaper topsheet material available from Fiberweb North America, Inc. are characterized in Table I-B.

The strip tensile strength, caliper (under compression), strike-through and surface rewet properties of the samples in the foregoing examples were tested according to the procedures outlined below. Additionally, softness, fuzz level, handle-o-meter and drape length of certain of the examples were also tested according to the procedures outlined below. The basis weight and caliper values for the multiple-layer control examples were not measured but the values measured for the single-layer control examples were multiplied by the applicable factor and listed in Tables I-A and I-B.

Strip Tensile Strength

Strip tensile strength was evaluated by breaking a one inch long sample generally following ASTM D1682-64, the One-Inch Cut Strip Test. The instrument crosshead speed was set at 2 inches per minute and the gauge length was set at 3 inches. The tensile strength in both the machine direction (MD) and the cross machine direction (CD) was evaluated. The strip tensile strength or breaking load, reported in grams per inch, is the average of at least eight measurements.

Caliper (Under Compression)

Caliper was determined by measuring the distance between the top and the bottom surface of the sheet generally following ASTM D1777-64 while the sheet was held under a compression loading of 95 grams per square inch. The result, reported in mils, is generally the average of ten measurements.

Strike-Through

Strike-through was evaluated by a method similar to that described in U.S. Pat. Nos. 4,041,951 and 4,391,869, incorporated herein by reference. Strike-through was measured as the time for 5 ml of synthetic urine solution, placed in the cavity of the strike-through plate, to pass through the sample fabric into an absorbent pad. The result, reported in seconds, is generally the average of four tests.

Surface Wetness

Surface Wetness was evaluated by a method similar to that described in U.S. Pat. Nos. 4,041,951 and 4,391,869, incorporated herein by reference. Surface Wetness, reported in grams, was evaluated by adding synthetic urine through the sample into the absorbent pad until the absorbent pad was nearly saturated. Thus, the sample fabric was wet at the beginning of the surface rewet test. For results denoted as Surface Wetness A, the loading factor was slightly less than 4 grams of synthetic urine per gram of absorbent sample. A uniform pressure loading of 0.5 psi was then applied and the procedure concluded as disclosed in the above patents. For results denoted as Surface Wetness B, the loading factor was increased to slightly more than 4 grams of synthetic urine per gram of absorbent sample so that the absorbent pad was saturated with synthetic urine. A uniform loading pressure of 1.0 psi was then applied and the procedure concluded as disclosed in the above patents. The results, reported in grams, is generally the average of four tests. Surface Wetness A is believed to be a good indicator for baby diapers that do not include Super Absorbent Powder. Surface Wetness B is believed to be a good indicator for adult diapers.

Softness

Softness of selected examples was evaluated by an organoleptic method wherein an expert panel compared the surface feel of Example Fabrics with that of controls. Results are reported as a softness score with the higher values denoting a more pleasing hand. Each reported value is for a single fabric test sample but reflects the input of several panel members.

Fuzz

The surface of selected samples was evaluated for fuzz by rubbing a slightly abrasive surface cyclically over the fabric surface. The fibers removed from the surface of the sample are weighed and the results reported as a fuzz level with the lower values denoting an increased resistance to fuzz generation. The results, reported in milligrams (mg), are generally the average of four tests.

Handle-O-Meter

Stiffness of selected examples was evaluated following INDA IST 90.0-75 (R82) Handle-O-Meter Stiffness test procedure. Handle-O-Meter was measured as the force required to deform the fabric into a slot with parallel edges by means of a moving blade. The results, reported in grams, is generally the average of eight tests.

Drape Length

Flexibility of selected examples was evaluated following ASTM D 1388-64 (1975) Cantilever test procedure. Drape Length was measured as the distance required for the test specimen to break a predetermined plane when extended horizontally from the test surface as defined in the specified procedure. The results, reported in centimeters (cm), is generally the average of eight tests.

TABLE I-A

MULTILAYER THERMALLY BONDED NONWOVEN FABRIC FOR SANITARY APPLICATIONS

| | BASIS | | TENSILES | | | REWET (g) | |
|---|---|---|---|---|---|---|---|
| | WEIGHT | CALIPER | (g/in) | | STRIKETHROUGH | A | B |
| SAMPLE | (g/yd$^2$) | (mils) | MD | CD | (sec) | (0.5 psi Compression) | (1.0 psi Compression) |
| Example 1 | 30.2 | 15.6 | 1765 | 1355 | 1.19 | 0.12 | 1.17 |
| Control 1A | 8.5 | 4.5 | 530 | 440 | 2.09 | 0.76 | 2.10 |
| Control 1B | 25.5 | 13.5 | n.a. | n.a. | 1.78 | 0.14 | 0.31 |
| Example 2 | 26.2 | 13.7 | 1950 | 1615 | 1.48 | 0.13 | 2.40 |
| Control 2A | 12.6 | 6.1 | 875 | 745 | 1.93 | 0.17 | 1.87 |
| Control 2B | 25.2 | 12.2 | n.a. | n.a. | 1.89 | 0.14 | 0.51 |

TABLE I-A-continued

MULTILAYER THERMALLY BONDED NONWOVEN FABRIC FOR SANITARY APPLICATIONS

| SAMPLE | BASIS WEIGHT (g/yd²) | CALIPER (mils) | TENSILES (g/in) MD | TENSILES (g/in) CD | STRIKETHROUGH (sec) | REWET (g) A (0.5 psi Compression) | REWET (g) B (1.0 psi Compression) |
|---|---|---|---|---|---|---|---|
| Example 3 | 32.2 | 17.3 | 2390 | 2080 | 1.20 | 0.12 | 1.90 |
| Control 3A | 15.0 | 7.5 | 1095 | 1160 | 2.45 | 0.12 | 1.45 |
| Control 3B | 30.0 | 15.0 | n.a. | n.a. | 1.76 | 0.11 | 0.48 |
| Example 4 | 37.4 | 17.4 | 2975 | 620 | 1.19 | 0.84 | 2.96 |
| Control 4A | 17.7 | 6.7 | 1375 | 690 | 2.02 | 0.76 | 3.34 |
| Control 4B | 35.4 | 13.4 | n.a. | n.a. | 1.97 | 1.15 | 3.30 |
| Example 5 | 25.4 | 11.6 | 2105 | 460 | 1.56 | 0.17 | 2.68 |

n.a. = Not Available

TABLE I-B

MULTILAYER THERMALLY BONDED NONWOVEN FABRICS FOR SANITARY APPLICATIONS

| SAMPLE | BASIS WEIGHT (g/yd²) | CALIPER (mils) | TENSILES (g/in) MD | TENSILES (g/in) CD | STRIKETHROUGH (sec) | REWET (g) A (0.5 psi Compression) | REWET (g) B (1.0 psi Compression) |
|---|---|---|---|---|---|---|---|
| Example 6 | 27.7 | 11.8 | 1565 | 670 | 1.60 | 0.37 | n.a. |
| Example 7 | 25.0 | 10.3 | 1560 | 1425 | 1.52 | 0.09 | n.a. |
| Example 8 | 28.8 | 12.4 | 1200 | 194 | 2.08 | 0.39 | n.a. |
| Example 9[1] | 28.5 | 14.2 | 718 | 205 | 1.84 | 0.20 | n.a. |
| Example 10 | 30.0 | 15.3 | 1420 | 298 | 1.73 | 0.12 | n.a. |
| Example 11[1] | 30.0 | 16.3 | 1125 | 214 | 1.73 | 0.12 | n.a. |
| Example 12 | 26.2 | 12.4 | 1830 | 1555 | 1.53 | 0.12 | 0.73 |
| Control 12A | 12.6 | 6.1 | 875 | 745 | 1.93 | 0.17 | 1.87 |
| Control 12B | 25.2 | 12.2 | n.a. | n.a. | 1.89 | 0.14 | 0.51 |
| Control 13 | 18.5 | 10.0 | 1165 | 870 | 1.70 | 0.11 | n.a. |
| Control 14 | 15.6 | 10.0 | 1290 | 900 | 1.86 | 0.20 | n.a. |
| Control 15 | 19.2 | 11.2 | 2550 | 440 | 2.06 | 0.18 | n.a. |

n.a. = Not Available
[1]Not a product of our invention.

TABLE II

MULTILAYER THERMALLY BONDED NONWOVEN FABRIC FOR SANITARY APPLICATIONS

| SAMPLE | FUZZ (mg) Top[1] | FUZZ (mg) Bottom | HANDLE-O-METER (g) CD Top | HANDLE-O-METER (g) CD Bottom | HANDLE-O-METER (g) MD Top | HANDLE-O-METER (g) MD Bottom | DRAPE LENGTH (cm) CD | DRAPE LENGTH (cm) MD | SOFTNESS |
|---|---|---|---|---|---|---|---|---|---|
| Example 8 | 1.0 | 0.1 | 19.9 | 20.1 | 49.0 | 50.9 | 3.4 | 5.6 | 35 |
| Example 9[2] | 4.2 | 2.4 | 22.6 | 25.5 | 40.9 | 46.1 | 3.4 | 4.6 | 55 |
| Example 10 | 2.2 | 0.6 | 36.8 | 36.6 | 48.4 | 46.5 | 4.4 | 5.2 | 53 |
| Example 11[2] | 3.1 | 5.9 | 39.1 | 41.7 | 49.9 | 51.4 | 3.9 | 4.7 | 53 |

[1]Top represents patterned surface of the sample. Bottom represents the side of the sample contacting the smooth roll during calendering.
[2]Not a product of our invention.

The invention has been described in considerable detail with reference to its preferred embodiments. However, it will be apparent that numerous variations and modifications can be made without departure from the spirit and scope of the invention as described in the foregoing specification and defined in the appended claims.

That which is claimed is:

1. A multilayer thermally bonded nonwoven fabric which is particularly useful as a component in an absorbent product, said fabric comprising first and second prebonded nonwoven webs of fibers, each said web comprising a multiplicity of intralaminar point bond sites of compressed and fused fibers in discrete areas bonding the fibers thereof together to form a coherent web, and a plurality of interlaminar thermal bond sites of compressed and fused fibers securing directly together said first and second prebonded nonwoven webs in discrete areas, wherein at least some of said intralaminar point bond sites on each of said first and second prebonded webs are laterally offset from said interlaminar bond sites.

2. The multilayer thermally bonded nonwoven fabric according to claim 1, wherein said intralaminar point bond sites comprise discrete point bonds at spaced locations throughout said webs.

3. The multilayer thermally bonded nonwoven fabric according to claim 1 wherein said intralaminar point bond sites have a bond area of from about 5 to 30 percent of the area of the webs.

4. The multilayer thermally bonded nonwoven fabric according to claim 1, wherein said interlaminar thermal point bond sites comprise continuous line bonds securing together fibers of said first and second prebonded nonwoven webs.

5. The multilayer thermally bonded nonwoven fabric according to claim 4, wherein said continuous line bonds comprise lines of compressed and fused fibers of said first and second prebonded nonwoven webs.

6. The multilayer thermally bonded nonwoven fabric according to claim 5 wherein said continuous line bonds form a pattern of intersecting continuous lines, and further comprising raised portions of the surfaces of said first and second nonwoven webs between said intersecting continuous lines to give the surface of said fabric a quilted topography.

7. The multilayer thermally bonded nonwoven fabric according to claim 1 wherein at least one of said first and second prebonded nonwoven webs has hydrophilic properties.

8. The multilayer thermally bonded nonwoven fabric according to claim 1 wherein said nonwoven fabric is liquid permeable.

9. The multilayer thermally bonded nonwoven fabric according to claim 8 further comprising an absorbent layer having a first side adjacent one side of said thermally bonded nonwoven fabric and a substantially liquid impermeable layer adjacent an opposite side of said absorbent layer, said thermally bonded layer, said absorbent layer, and said liquid impermeable layer being secured together to form an absorbent article.

10. The multilayer thermally bonded nonwoven fabric according to claim 9, wherein said absorbent article is a diaper.

11. The multilayer thermally bonded nonwoven fabric according to claim 9, wherein said absorbent article is a feminine sanitary napkin.

12. The multilayer thermally bonded fabric according to claim 1 wherein each of said first and second prebonded nonwoven webs comprise thermoplastic substantially continuous filaments.

13. A multilayer thermally bonded liquid permeable nonwoven fabric which is particularly useful as a liner in an absorbent product, said fabric comprising:

first and second nonwoven webs formed of continuous filaments of a thermoplastic polymer, and arranged in opposing face-to-face relationship, said webs each having a basis weight of about 5 to 30 g/m$^2$, and said webs each including a multiplicity of intralaminar bond sites of compressed and fused fibers in discrete areas bonding the continuous filaments together to form a coherent web; and a plurality of interlaminar thermal bonds in discrete areas securing directly together said first and second nonwoven webs, said thermal bonds comprising areas wherein the filaments of said first and second webs are compressed and fused together and wherein at least some of said intralaminar thermal bonds in each of said first and second nonwoven webs are laterally offset from said interlaminar bond sites.

14. The multilayer thermally bonded nonwoven fabric according to claim 13 wherein said intralaminar bond sites comprise discrete point bonds at spaced locations throughout the webs.

15. The multilayer thermally bonded nonwoven fabric according to claim 13 wherein said intralaminar bond sites have a bond area of from about 5 to 30 percent of the area of the webs.

16. The multilayer thermally bonded nonwoven fabric according to claim 13 wherein said interlaminar thermal bonds comprise continuous line bonds securing said first and second nonwoven webs.

17. The multilayer thermally bonded nonwoven fabric according to claim 16 wherein said continuous line bonds form a pattern of intersecting continuous lines, and further comprising raised portions of the surfaces of said first and second nonwoven webs located between said intersecting continuous lines to give the surface of said fabric a quilted topography.

18. The multilayer thermally bonded nonwoven fabric according to claim 13 wherein said continuous filaments are polypropylene continuous filaments.

19. The multilayer thermally bonded nonwoven fabric according to claim 13 wherein said continuous filaments are polyethylene continuous filaments.

* * * * *